United States Patent [19]

Crump et al.

[11] 3,950,112

[45] Apr. 13, 1976

[54] FLUID MOVING DEVICES WITH MODULAR CHAMBER-FORMING MEANS AND MULTIPLE OUTLETS

[75] Inventors: Robert F. Crump, Louisville; Andrew H. Susemichel, Anchorage, both of Ky.

[73] Assignees: Robert F. Crump; Andrew H. Susemichel, both of Louisville, Ky. ; part interest to each

[22] Filed: Apr. 8, 1974

[21] Appl. No.: 459,079

[52] U.S. Cl. ..... 415/206; 415/219 C

[51] Int. Cl.[2] ..... F04D 29/44

[58] Field of Search..... 415/219 C, 204, 206, 199 A

[56] References Cited

UNITED STATES PATENTS

| | | | |
|---|---|---|---|
| 1,004,212 | 9/1911 | Smith | 415/206 |
| 2,330,938 | 10/1943 | Williams | 415/219 C |
| 2,341,871 | 2/1944 | Karrer | 415/204 |
| 2,710,573 | 6/1955 | Marker | 415/206 |
| 3,081,019 | 3/1963 | Freerol | 415/219 C |
| 3,211,360 | 10/1965 | Lyman et al. | 415/219 C |

FOREIGN PATENTS OR APPLICATIONS

| | | | |
|---|---|---|---|
| 1,116,535 | 2/1956 | France | 415/206 |
| 765,144 | 1/1957 | United Kingdom | 415/199 A |
| 1,206,406 | 9/1970 | United Kingdom | 415/206 |
| 121,027 | 3/1948 | Sweden | 415/219 C |

*Primary Examiner*—Henry F. Raduazo

*Attorney, Agent, or Firm*—Wood, Herron & Evans

[57] ABSTRACT

A centrifugal type fluid moving device having a rotor operating in a working chamber around it, wherein the working chamber is established by a plurality of working chamber defining modules each of which defines a "section" of overall working chamber. Each module presents an outlet for its respective section of the chamber. Both "tiered", or stacked, module sections, and "angular" module section embodiments are disclosed.

13 Claims, 13 Drawing Figures

FLUID MOVING DEVICES WITH MODULAR CHAMBER-FORMING MEANS AND MULTIPLE OUTLETS

This invention relates generally to fluid moving devices, such as blowers and compressors for moving gases and pumps for moving liquids, of the centrifugal type wherein the fluid flow is principally radial in the region of energy transfer. In devices of this general type, the fluid is urged toward an outlet by centrifugal force exerted on it by a rotor which turns within a space that is referred to as a "working chamber". The invention relates more particularly to working chamber defining modules for such devices, which modules can be arranged in various relations to one another to provide outlet ports in such orientations as may be desired for a given installation.

Centrifugal blowers or fans are widely used for providing directionalized air streams. Such devices commonly include, as part of the fan, a motor driven rotor having either curved or radial vanes, and which operates in a working chamber that is usually (although not always) defined by a surrounding "scroll", i.e., a volute or spiral-shaped housing which extends around the rotor. Air is caused to move outwardly by centrifugal force exerted on it by the rotor, and the scroll causes the air to flow circumferentially in the direction of rotation to an outlet. Centrifugal compressors are generally similar, but differ principally in that they handle gases under such conditions that the density of gas is changed appreciably, whereas with fans the change in density is small enough that compression effects are generally insignificant. Centrifugal pumps for moving liquids comprise another class of centrifugal fluid moving devices. They also have a working chamber around the tips of vanes on a rotor and within which the fluid is urged toward an outlet.

Centrifugal blowers are commonly used in air handling units for residential and commercial dwellings, including air conditioning and/or heating units. The unit may include a heat transfer element around the rotor through which either cooled or heated fluid is circulated, for air cooling or heating respectively, or an electric heater coil. The outlet may serve a single room or zone, or branched ductwork may lead from the outlet to divide the output air stream into different flows to serve a number of zones or rooms. For example, a ceiling type air conditioner may be mounted at a central location to serve several rooms via ductwork that branches from the single outlet to the respective rooms. The use of such branching ductwork is in many cases inconvenient and inefficient, since it may involve a right angular or even 180° turn in direction, which leads to energy losses, as well as increased cost of ductwork material.

Centrifugal fluid moving devices having multiple outlets are known, which provide outputs at multiple angular locations around the rotor. Buckwalter U.S. Pat. No. 1,256,977 shows a radiator fan wherein the working chamber is divided into two sections by diametrically opposed fixed walls that direct flow to opposite sides of the radiator. Smith U.S. Pat. No. 1,884,598 shows a fan with volutes that define two outlets, arranged at 180° to one another. Moss U.S. Pat. No. 2,157,002 shows a centrifugal compressor with a body having a plurality of fixed outlets in different directions of non-uniform circumferential spacing. Sheppard U.S. Pat. No. 3,305,163 shows different blowers with one, two, three or more outlets. McCarty U.S. Pat. No. 3,680,328 shows a room air conditioner with two fixed outlets. In none of those patents, however, is there any means of changing the position of the outlets within a given housing, so that a standard unit may be selectively ported to provide outlets in different directions as desired for a given installation.

Such multiple outlet systems are useful where the orientations of the outlets in fact correspond with the outlet flow direction needed for a particular installation, but if they do not, ductwork must again be used, to redirect the output streams as desired.

It has been the purpose of this invention to provide modular working chamber defining means for use with centrifugal fluid moving devices, whereby multiple flow outlets may be established at such various orientations as are desired for a given installation.

Briefly, in accordance with the invention, a series of standardized modules are provided which are shaped to be stacked along the height of the rotor, or fitted around the circumference of the rotor, of a centrifugal fluid moving device, to define various working chamber configurations. In other words, each module establishes a different "section" or portion of the overall working chamber. The section may be an axial section, i.e., one tier of a stack, or it may be an angular section, i.e., a circumferential segment. The word "section", as used herein, is meant to refer to both axial and angular subdivisions of the overall working chamber.

The modules cooperate to form the radially inwardly facing surface of the overall working chamber, which extends around the circumference and over the axial height of the rotor. They can be arranged with respect to one another, and with respect to the rotor, within a standardized housing, to provide one or more outlets at different positions and, optionally, outlets of different mass flow rates.

In the preferred embodiment of the invention for use with a centrifugal blower, a series of modules are provided which are relatively "thin" as compared to the axial dimension or length of the rotor, and which are stacked upon one another to define the overall working chamber which extends over the axial length of the rotor. Each module has a central opening bounded by a side wall, and comprises one layer, "tier", or section of the overall working chamber. Each such tier has an outlet for fluid moved by that axial section of the rotor which it encloses. The tiers can be oriented around the rotor axis so that their respective outlets are directed differently. Separators or axial flow isolating baffles are desirably provided between the modules or tiers to restrict fluid flow in the axial direction, i.e., from the working chamber of one tier to that of an adjacent tier, where it might be diverted to a different outlet. This helps to isolate the respective sections and thereby permits more independent behavior of each section. By orienting the modules of two axially adjacent tiers so that their respective outlets are aligned (i.e., open in the same direction), essentially a single outlet is defined which presents an area equal to the sum of the respective tier outlet areas. Thus, in this embodiment of the invention, the modules subdivide the overall working chamber into separate axial strata or sections.

In an alternative embodiment of the invention, modular elements are provided which divide the working chamber into different angular sections. These modules each extend around only a part of the rotor circumference, so that the overall working chamber is thus subdivided into a series of angular sectors, each with a separate outlet, aligned in a different direction. A series of these "sector" modules is provided so that by selecting the appropriate modules, one, two, three or four outlets or more may be provided having different effective outlet areas, flow rates, or velocities.

The "package" or system in accordance with the invention is useful wherever differently oriented, multiple outlet flows are desirable to accommodate particular installation conditions. By way of example, in the residential construction industry a distributor or dealer in air conditioning can stock a standardized motor and rotor unit, housing, and a series of the chamber-forming modules, from which each unit can individually be ported to provide outlets as desired.

The multiple outlets may differ among themselves, not only in terms of direction or orientation, but also in respect to the relative proportion of the total output flow from the rotor which the various outlets deliver. For example, outlets can be provided which will divide the total output flow in two or more equal proportions, i.e., 50%–50%, or in different proportions, 50%–25%–25%, 75%–25%, etc.

The proportion of total output flow delivered by a separate module outlet opening depends upon the proportion of the total rotor area which that outlet serves. An outlet of a tier which covers ⅓ the axial length of the rotor, or a sector module which covers 120° (⅓) of the rotor circumference, will each deliver about ⅓ of the total output mass flow rate.

Apart from proportions of flow, different outlet configurations can also be formed by use of the modules to provide different outlet velocities. The velocity of the fluid issuing from a given section of the working chamber is primarily a function of the shape of the volute of that section. By using modules with differently shaped volute curves at the working chamber surface, leading to wider or narrower outlets, different outlet velocities can be provided. The modules may be formed of various materials including metal, foam or molded plastic inserts, and so on.

The invention can best be further described, and its advantages and features explained, by reference to the accompanying drawings showing various embodiments thereof, wherein.

Figure 2:
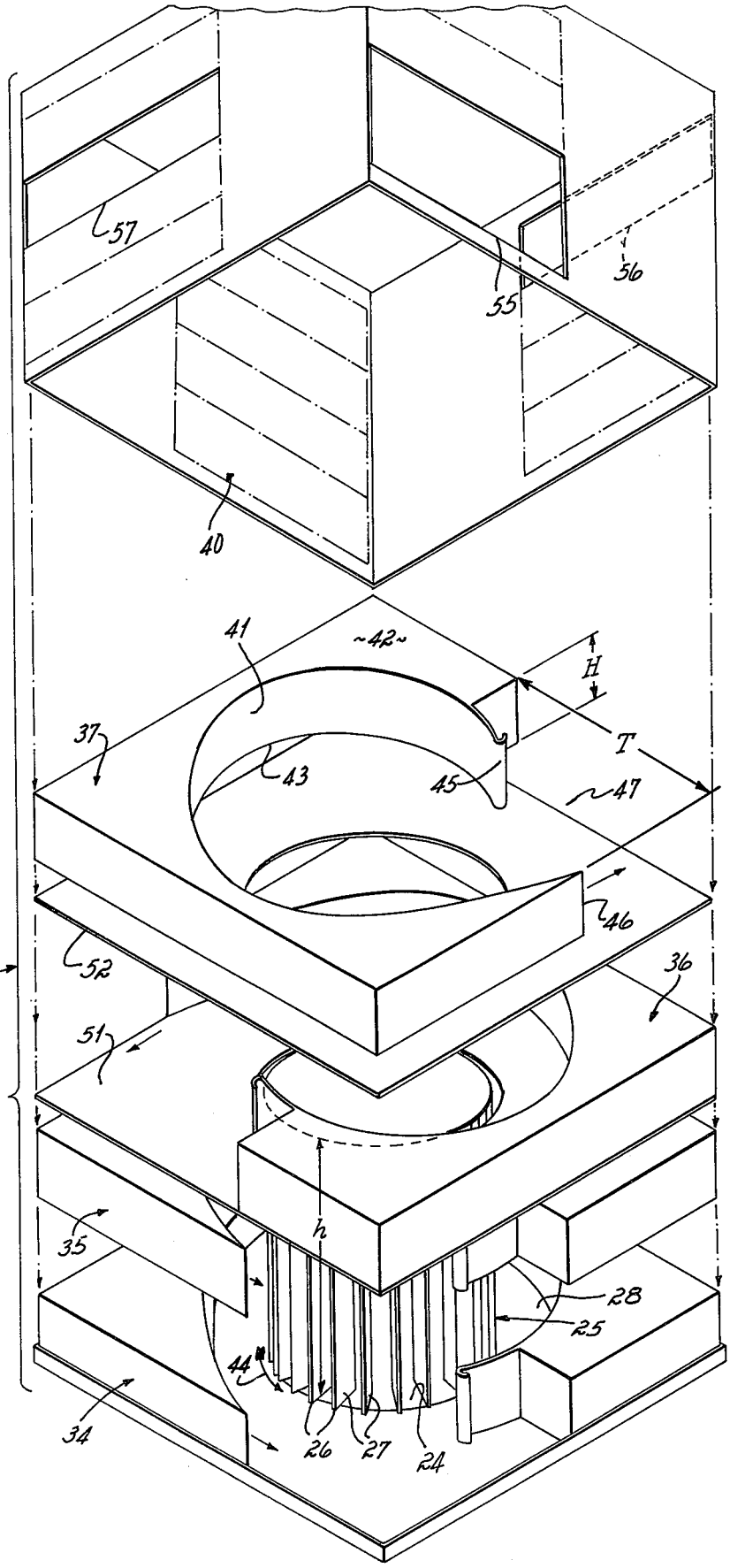
FIG. 2 is an exploded perspective of a centrifugal blower unit in accordance with a preferred embodiment of the invention, showing a series of modules which are stacked on one another over the axial height of the rotor of the blower unit.
Figure 3:
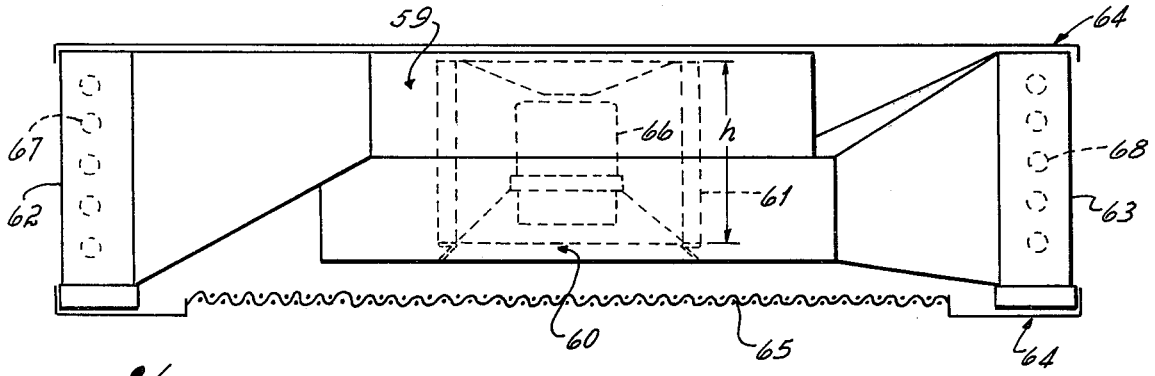
Figure 4:
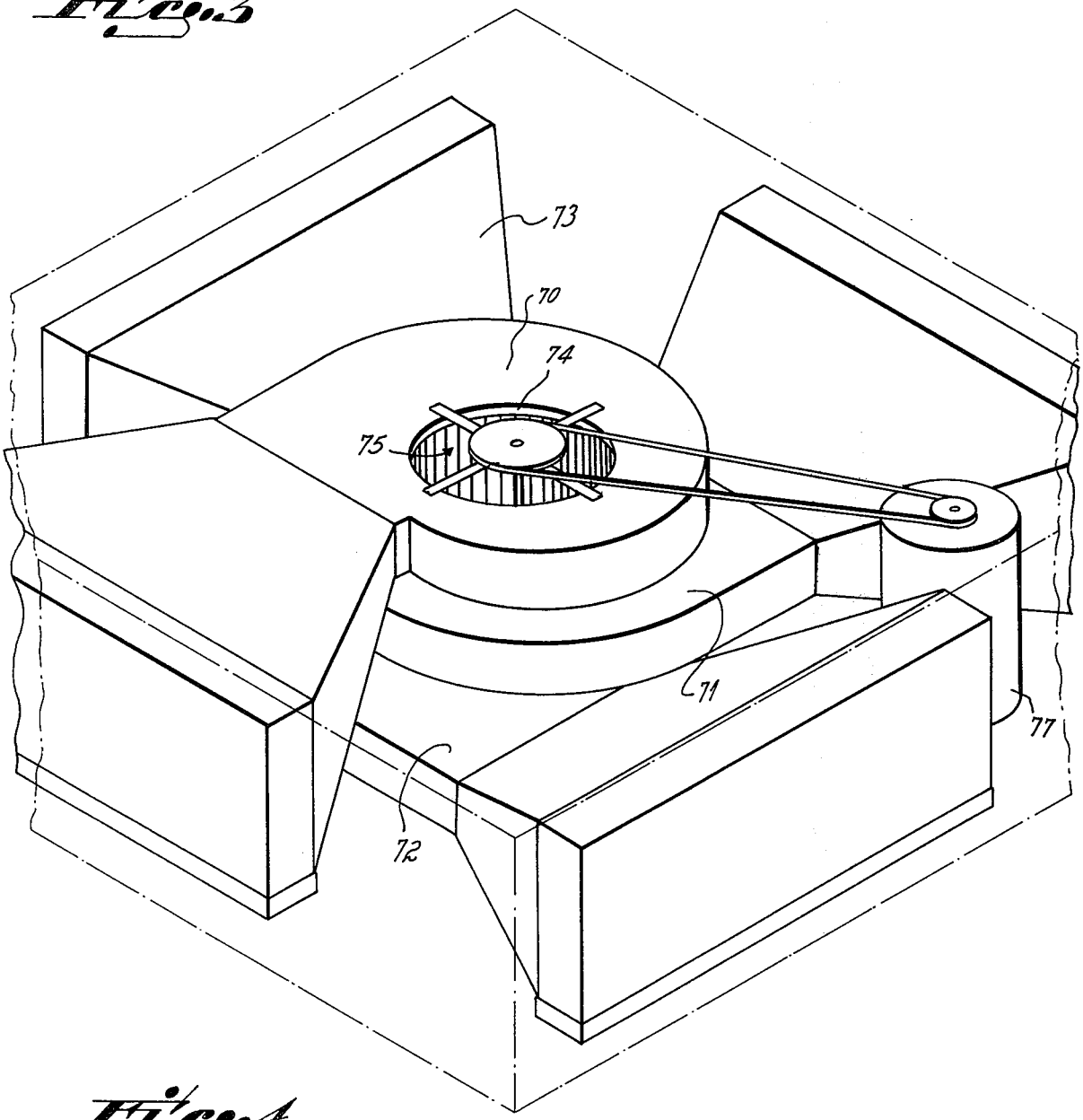
Figure 5:
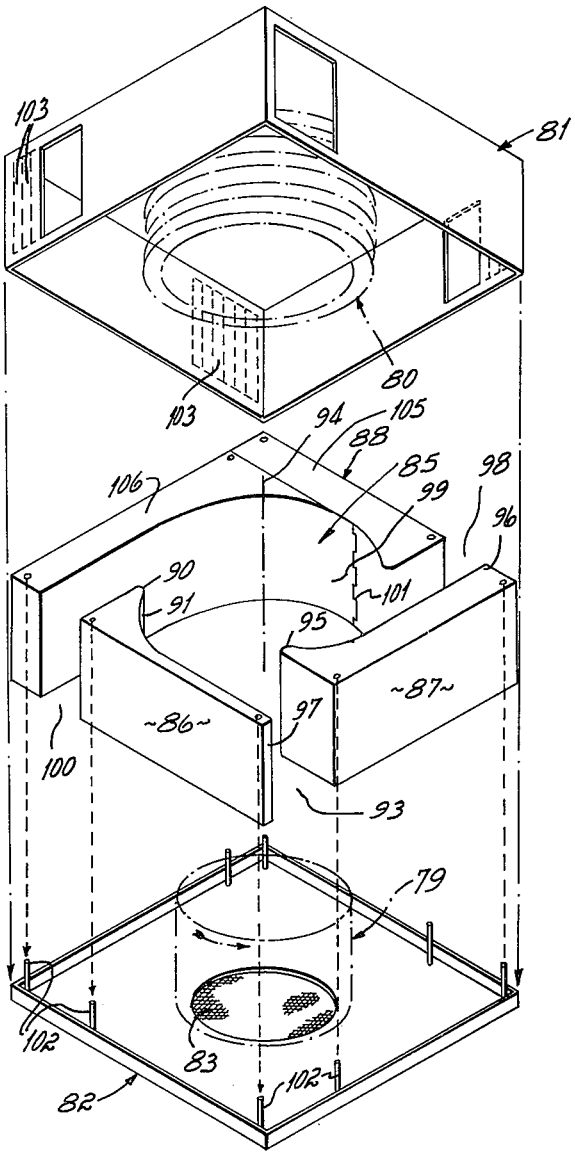
Figure 6:
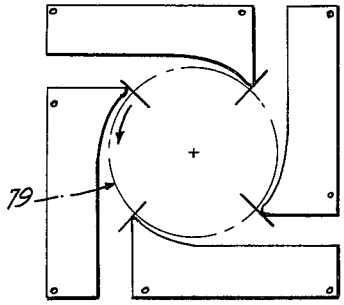
Figure 7:
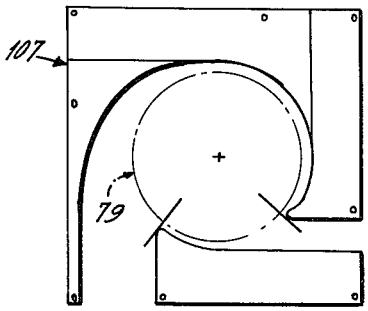
Figure 8:
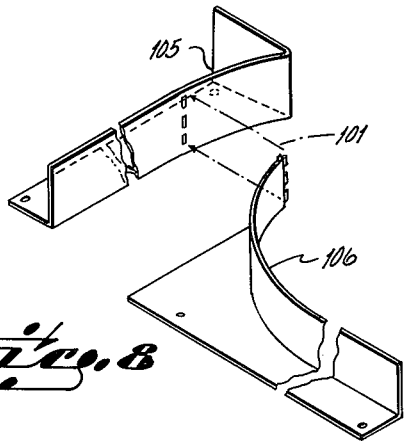
Figure 9:
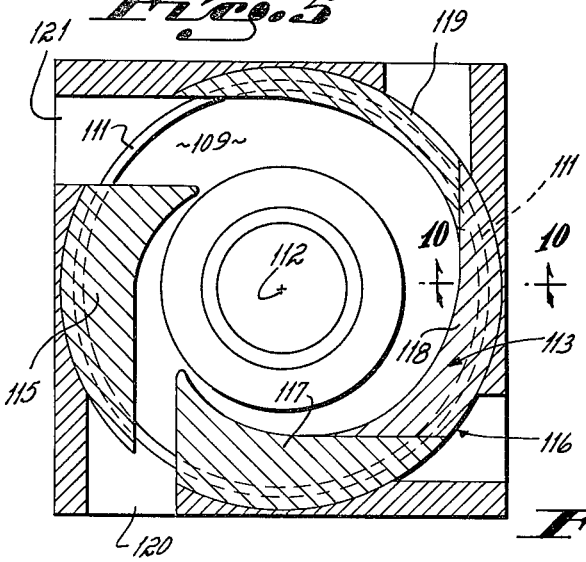
Figure 10:
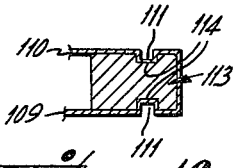
Figure 11:
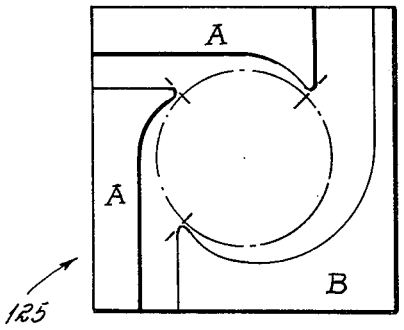
Figure 12:
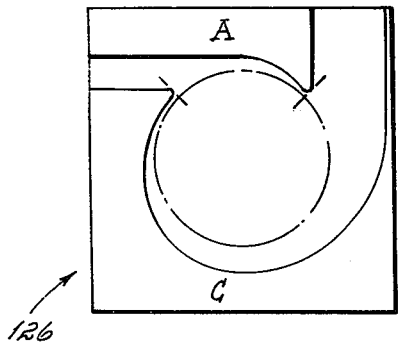

FIG. *2a* is a side view of another unit of the general type shown in FIG. 2, but with a heat exchange element mounted at the inlet;

FIG. 3 is an axial section of a two outlet blower unit in accordance with another embodiment of the invention, wherein two modules are stacked one upon another to provide two oppositely disposed, flared outlets;

FIG. 4 is a perspective view, somewhat diagrammatic in nature, of another arrangement of a blower unit of the general type shown in FIG. 3, but with four stacked modules with four equal area outlets arranged at 90° intervals with respect to one another;

FIG. 5 is an exploded perspective of another embodiment of the invention wherein the modules are in the form of semi-circumferential segments which divide the working chamber into separate angular sections around it;

FIG. 6 is a horizontal section, diagrammatic in nature, of a unit of the general type shown in FIG. 5 but illustrating different shapes of semi-circumferential modules arranged to provide four equal area outlets spaced 90° apart;

FIG. 7 is a view similar to FIG. 6, but shows different semi-circumferential modules arranged to provide two outlet ports at right angles to one another, one port delivering a major portion of the total output and the other delivering a minor portion;

FIG. 8 is a fragmentary perspective view showing one manner in which elements of semi-circumferential modules may be interconnected;

FIG. 9 is a modification of the embodiment of FIG. 5, wherein the modules can be turned around the rotor axis within their housing, for making minor adjustments in their relative deliveries;

FIG. 10 is a longitudinal section taken along line 10—10 of FIG. 9 showing the manner in which the modules are guided for rotational adjustment; and FIGS. 11 and 12 are diagrammatic horizontal sections of other modifications of the invention, showing the use of angularly sectioned modules to provide multiple outlets of different configurations, within a single tier of a stack of axially sectioned modules.

Figure 1:
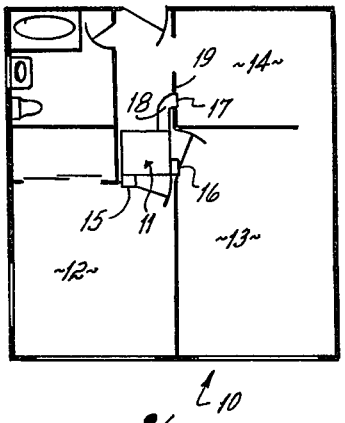
FIG. 1 is a plan view of a multi-room apartment having a ceiling mounted, centrally located air conditioning unit in accordance with the invention.

By way of example, a typical environment in which the invention is useful is illustrated in FIG. 1. A four room structure such as the apartment designated by 10 is provided with a ceiling mounted, centrally located air conditioning unit 11 in accordance with the invention. The unit 11 includes a centrifugal blower, not shown in FIG. 1. Three separate rooms, designated as 12, 13, and 14, are served by the unit 11 which has three separate outlets 15, 16 and 17 for the respective rooms. The three outlets are oriented at right angles with respect to one another, outlet 15 opening directly into room 12, outlet 16 opening directly into room 13, and outlet 17 having a right angular duct 18 which leads from unit 11 through a partition or wall 19, into room 14.

In a structure wherein the different rooms present different heating/cooling loads, it may be desirable to deliver different flow rates to the different rooms. For purposes of illustration it is assumed that by reason of the setting of the building structure, its insulation, window placement, or other factors, it is desirable for the structure shown in FIG. 1 to supply room 13 with about 50% of the total output of the unit, 25% to room 12, and 25% to room 14. (It should be understood that the number, positions and relative sizes of the outlets are not critical to the invention.)

The blower of air conditioning unit 11 includes a motor driven rotor which turns within a working chamber. Air moved by rotation of the rotor may pass over heat transfer elements to heat or cool it. As will now be described in detail, the working chamber is defined by a series of modules which are mounted around the rotor within the same outer housing, and which in effect form a plurality of smaller working chambers, which are desirably essentially separate from one another, and each of which delivers air to a separate outlet, e.g., the outlets 15, 16 and 17.

In the preferred form of the invention, a plurality of working chamber modules are stacked axially one upon another around the rotor of the blower unit. Illustrative module forms and arrangements in accordance with this embodiment are shown in FIGS. 2, 3 and 4. FIG. 2 shows a four-module air handling unit with three outlets which provide flow ratios of 50%, 25% and 25%, suitable for installation in an environment such as that illustrated in FIG. 1.

Referring to FIG. 2 in more detail, a motor (not shown) drives a rotor 25, shown as being of the forward curved blade type. The details of the motor and rotor 25 are well known per se in the art, and do not comprise the invention. The rotor receives intake air through one or both axial ends, one of which is designated 24. The tips 26 of the fan blades 27 move in a circular path and centrifugally impel air into a pumping space or working chamber 28 which generally surrounds blades 27.

Fan 25 has an axial length dimension h (see also FIG. 3). Optionally, a heat transfer element in the form of a coil may be disposed within or adjacent to the pumping space 28, so that air flows over it. Heated or cooled fluid is supplied to the coil or alternatively, the coil may be an electrical heating element. The means for heating and/or cooling such a coil, if present, may be conventional and do not form part of the invention.

In the embodiment of FIG. 2, the working chamber is established by chamber-defining means in the form of four modules 34, 35, 36 and 37, stacked axially one above the other around the rotor, over its full axial dimension h. Each module 34–37 is of the same external shape, and is sized to fit within an overall outer housing or cover 40. Each module presents a central space which is shaped (in plan view) to provide a scroll-like surface 41 which forms an outer boundary to that portion of the total pumping space 28 which the respective module encompasses. The scroll surfaces 41 are perpendicular to the parallel upper and lower surfaces 42 and 43 of the respective modules. Each surface 41 has a leading edge 45 from which it sweeps to a downstream or trailing edge 46 (in FIG. 2, it is assumed that the rotor 25 turns in the counterclockwise direction as indicated by the arrow 44). The distance between the scroll surface 41 and the periphery of the blades is at a minimum adjacent the leading edge 45, where there is just working clearance, and increases around the circumference of the rotor from the leading edge to the trailing edge 46, so that the surface 41 is a spiral or volute. An outlet 47 for the working chamber within the module 37 is presented between the leading edge and trailing edge 45 and 46, and this outlet has a throat dimension T (see FIG. 2). The modules may be constructed of metal, shaped from plastic or molded to provide a smooth scroll surface 41. It is desirable to provide as smooth a contour as possible.

In the embodiment of FIG. 2, all four modules 34–37 are substantially identical in exterior shape, to fit in the housing. However, they are oriented differently around the rotor to provide different outlet formations, and they may have identical or differently shaped volutes to provide equal or different outlet velocities. Specifically, in the figures, the upper module 37 is oriented so that its outlet is directed oppositely, i.e., at 180°, from the outlet of the next lower module 36. The lowermost two modules 34 and 35 are both oriented in the same direction so that the outlet of one directly overlies the outlet of the other, and at right angles to the direction of the outlets of the other modules 36 and 37. Together the two lower modules cooperate to form a single outlet having twice the height, or axial dimension, of each module individually. The areas of the outlets of the modules all being equal, this arrangement will be seen to subdivide flow so that approximately 50% of the flow will be directed through the combined opening of modules 34 and 35, 25% through module 36, and the remaining 25% through module 37.

For the purpose of restricting and minimizing cross-flow, that is, flow around the blade tips which is in the axial direction of the rotor, separators or baffles 51 and 52 are disposed between adjacent modules 35, 36 and 37. Each separator has a central circular opening, sized larger than the rotor diameter so that it encircles the tips. This has been found effective to balance flow to equal outlet areas, and to prevent "starving" of any outlet, so that each tier delivers approximately the same flow. The baffles 51 and 52 are relatively thin and are simply sandwiched between adjacent modules. No separator is shown between modules 34 and 35 since they effectively act as one, but one could be employed.

The housing 40 shown in FIG. 2 is ported or cut away as at 55, 56 and 57, to provide outlets at positions which, in the assembled unit, align with the openings of the respective modules. The openings 55, 56 and 57 may be demarcated by knock-out lines and punched to fit the particular configuration in which the modules are arranged for a given installation.

As is apparent from FIG. 2, many different outlet configurations can be obtained by use of a single standardized module configuration. By arranging all the modules identically, they would in effect define a single large opening. On the other hand, they may all be positioned differently, to provide for different openings, and so on. In this connection, it is important to recognize that the invention is not restricted to any particular number or shape of modules, or module arrangement. In the FIG. 2 example, each module has a thickness which is approximately a simple fraction (25%) of rotor dimension *h*, so that four modules cover substantially the entire height of the rotor, but different module/rotor proportions may of course be used. Moreover, modules may be provided with differently shaped volute curves, leading to differently sized throats, to provide other outlet flow velocities.

Figure 2A:
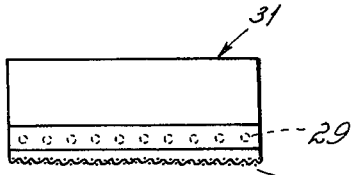

FIG. 3 illustrates a related form of the invention, in which two modules 59 and 60 are stacked one upon the other, to enclose substantially the full height *h* of rotor 61, and to provide two outlets 62 and 63 which are 180° apart. The two modules are essentially identical, but one is upsidedown with respect to the other. In this embodiment the housing 64 mounts an intake filter 65 directly beneath the motor 66 and rotor 61. Return air is drawn through the filter 65 into the rotor intake. This unit is especially useful for ceiling mountings, because of its relatively "flat" profile, to serve one or two separate climate zones. Alternatively, a horizontal coil 29 may be placed adjacent the filter 30 at the inlet to fan 31, as shown in FIG. 2a.

It will be noted that in comparison to the FIG. 2 embodiment, each of the outlets 62 and 63 of the FIG. 3 embodiment extends essentially the full height of the housing. Each module 59 and 60 flares outwardly from an approximate *h*/2 thickness at the rotor, to a wide opening 62 and 63. The purpose of this is to reduce the velocity of the air passing over the coil so that moisture condensing on the coil does not pass into the discharge air stream. Heat transfer coils 67, 68 may be provided at the mouth of the respective openings 62 and 63.

In FIG. 4, four modules 70, 71, 72 and 73 (only partially visible), with projecting flared full height outlets, are arranged all at right angles. Each of the modules is a separate "package". In the embodiment shown, the upper and lowermost modules 70 and 73 are identical, and the inner modules 71 and 72 are identical, although unequal height modules can be used. Each has an upper and lower surface with an aperture such as that at 74 which closely encircles the rotor to restrict axial flow. The rotor 75 is journaled in bearings (not shown) in the upper and lower modules. A motor 77 is mounted between two outlets and drives the rotor 75 by a belt drive. The axial dimension of each module, where it surrounds the rotor, is approximately $h/4$.

In the embodiments discussed in detail above, the modules have been configured to cover different axial sections of the rotor, each module having a thickness or axial dimension which is only a fraction of the axial dimension $h$ of the rotor. In accordance with another embodiment of the invention, the modules are configured to subtend different angular sections of the circumference of the working chamber, within the same axial space. This is shown in FIGS. 5–10.

Referring to FIG. 5, there is shown an air cooling-/heating unit having a rotor 79 which is centered axially within a heat transfer coil 80. Coil 80 is mounted to a cover 81, which may be of metal, which cooperates with a bottom plate 82 to form a housing for the unit. The bottom plate 82 is provided with an intake air filter 83. A working chamber generally at 85 around the rotor is defined by and within a plurality (three, in the embodiment shown) of scroll-forming modules 86, 87 and 88. Each of these modules 86–88 may extend the full height of the rotor, but it will be noted that each module forms only a part of the circumference of the working chamber. More specifically, module 86 includes a leading edge 90 which in the assembled structure is close to coil 80, or to the rotor vane tips if no coil is present (see FIGS. 6 and 7). From the leading edge 90 the working chamber surface 91 of module 86 recedes radially from the rotor (the rotor is designated by a dotted line at 79 in FIG. 6 and is assemed to rotate in counterclockwise direction) to form a sector or segment of a volute or scroll. The surface 91 of module 86 leads to an outlet 93 between segments 86 and 87. In the embodiment shown in FIG. 5, an angle of 90° is subtended between leading edge 90, the axis 94 of the unit, and the leading edge 95 of succeeding module 87. This establishes that approximately 25% of the total output mass flow rate will be delivered to the outlet 93.

Module 87 is generally similar to module 86, except it will be noted that its trailing edge portion 96 is relatively thick in comparison to the corresponding trailing portion 97 of module 86. This restricts or narrows the outlet 98 between modules 87 and 88. The spacing between leading edge 95 of module 87 and the leading edge of the adjacent module 88 is again 90°, so that about 25% of the total flow is delivered to outlet 98. By reason of the different shape of the volute leading to outlet 98, the outlet has a smaller throat dimension, and the outlet flow will have a higher velocity than the flow at outlet 93.

The third module 88 is conveniently comprised of two elements 105 and 106 which present working chamber surfaces that are faired into one another and together form a smooth surface. It can be seen that element 105 is substantially the same as module 87. Element 106 joins element 105 at 99 and leads to the third outlet 100, to which the remaining approximately 50% of the flow is delivered.

The scroll-forming elements and modules of this embodiment can be made of metal, plastic, or other material. FIG. 8 illustrates the manner in which separate elements may be joined together as at 101, to form a suitable curve. The individual segment may be positioned on alignment pins 102 which project upwardly from the base plate 82. The housing cover 81 is provided with knock-out partitions as at 103 by which outlets can be formed, in accordance with the size and positions of the respective openings 93, 98 and 100 between the modules.

By use of a series of standardized sector elements of the type shown in FIG. 5 with a standard housing, it is possible to form various numbers and sizes of outlets for a given rotor. In FIG. 6 there is illustrated a four outlet arrangement utilizing four single element modules, each of the type shown at 87 in FIG. 5, with each outlet delivering 25% of the total output flow. Each module describes 90° of the working chamber, as indicated by the short radial lines at the leading edge of each. In FIG. 7 there is shown a two outlet arrangement with a 75% – 25% flow distribution. The FIG. 7 embodiment makes use of three different sector elements, interconnected to form a single module 107 that extends around 270° of the rotor circumference. From these examples and this disclosure those skilled in the art will recognize that by using a series of elements which are positionable to form working chamber sectors of different arc lengths, it is possible quickly to assemble units with one, two, three or four outlets which moreover may be of different sizes for different air outlet velocities and flow proportions.

FIGS. 9 and 10 show a modification with angular scroll sectors which are rotatable within the housing around the axis of the rotor relative to one another, so that the positions and widths of the outlets, and the flow distribution between them, can be adjusted. More particularly, as shown in FIG. 10, the housing base 109 and cover 110 are provided with circular bosses or tracks 111 which define a circular guide path around the rotor axis 112. Each module 113 is grooved as at 114 on its upper and lower surfaces, to slidably receive the tracks 111, 111, so that it can be rotated around the axis 112. FIG. 9 shows an arrangement wherein two modules 115 and 115, the latter comprising three different elements 117, 118 and 119, are positioned within the housing to define two outlets 120 and 121. Elements 117, 118 and 119 abut one another end to end to form the module 116 which subtends 270 degrees of the rotor circumference. The outer surfaces of the element are circular and the working chamber surfaces 124 form two volute or spiral sections.

From the foregoing description those skilled in the art will understand that it is also possible to utilize a plurality of angular section modules as a single tier of the axially stacked module embodiment first disclosed, to provide multiple outlets within each tier. FIGS. 11 and 12 show two different modules for this purpose, each axially stackable section being comprised of plural angular sections. Each of the axial sections 125 and 126 shown in these figures comprise two angular sections, each with a separate outlet, and formed by a series of different elements designated A, B and C. The two sections 125 and 126, if stacked, will provide multiple outlets in each plane.

In the detailed description the fluid moving device has been illustrated as a fan. However, those skilled in the art will appreciate that the invention is equally useful with liquid or compressed gas moving devices of centrifugal type.

Having described the invention what is claimed is:

1. A centrifugal type fluid moving device comprising, a rotor, drive means for rotating said rotor about an axis, chamber defining means establishing a working chamber around the rotor in which the rotor moves fluid centrifugally, said chamber means comprising a plurality of modules around the rotor, each module having an axial dimension which is a fraction of the axial dimension of the rotor, the modules being stacked axially upon one another over the length of the rotor, each module forming an axial section of the working chamber, the modules presenting outlets for the respective axial sections of the working chamber which they respectively define, said device also including isolating means intermediate the length of the rotor and between axially adjacent modules, said isolating means restricting flow in the direction axially of said rotor from the working chamber section of one said module into that of the adjacent module, and a housing adapted to receive a plurality of said modules in different orientations, the housing including selectively openable outlet ports, the positions of the openable ports corresponding to different possible orientations of modules in the housing.

2. The device of claim 1 wherein the housing has walls which are scored to provide a plurality of knock-out ports therein according to the different orientations in which said modules can be assembled.

3. The device of claim 1 wherein said rotor has blades for moving air.

4. The device of claim 1 wherein said modules have parallel top and bottom surfaces, each module being an integral unit with scroll shaped internal openings and side walls which extend between the said top and bottom surfaces, each module also having an outlet leading outwardly from said internal opening.

5. The device of claim 4 wherein at least some of the outlets of the respective modules extend in different directions from one another.

6. The device of claim 4 wherein the isolating means are flat baffles having a central opening sized to encircle said rotor.

7. The device of claim 1 wherein each module includes flared outlet duct which leads to an outlet with a dimension in the direction of said axis which is greater than the axial dimension of the said module, the respective modules oriented around the rotor so that their outlets face in different directions such that the flared ducts do not interfere with one another.

8. The device of claim 1 wherein at least one module comprises a plurality of scroll shaped elements, each element presents only an angular part of the working chamber section of said module, there being outlets between the adjacent elements.

9. The device of claim 1, further wherein at least two of said modules are stacked upon one another in such orientation that an outlet of each is combined to form a single larger outlet.

10. The device of claim 1 wherein said module is of the same external shape, sized to fit within the housing, and each module presents a central space which is shaped to provide a scroll-like surface that forms an outer boundary of that portion of the working chamber which the respective module defines.

11. In combination, a rotor for moving fluid centrifugally, drive means for rotating said rotor about an axis, a series of modules mountable around the rotor to define a working chamber for fluid moved centrifugally by rotation of the rotor, each module forming a section of the working chamber, the modules providing outlet for the respective sections of the working chamber, the modules of the series presenting different portions of the working chamber, each module being selectively orientable and mountable in a plurality of different orientations around said rotor to provide a plurality of different outlet configurations therefor, and a housing adapted to receive a plurality of said modules in a range of different orientations, the housing including selectively openable outlet ports, the positions of the openable ports corresponding to different possible orientations of modules in the housing, said housing further including means for engaging and holding the modules spaced angularly apart at different radial positions around said rotor, said outlets being presented at different angular positions.

12. The combination of claim 11 wherein the section of the working chamber formed by each of said modules has an axial dimension substantially equal to that of the working chamber, and each module forms a different angular section of said working chamber.

13. The device of claim 11 wherein said modules themselves are assembleable from elements each defining a scroll-shaped portion of the working chamber surface, said elements assembleable to form a larger portion of a scroll.

* * * * *